US006321406B1

(12) United States Patent
Kloepfer et al.

(10) Patent No.: US 6,321,406 B1
(45) Date of Patent: Nov. 27, 2001

(54) CLEANING DEVICE

(75) Inventors: Martin Kloepfer, Winnenden (DE); Ingo Neumayer, Lauterach (AT)

(73) Assignee: Alfred Kaercher GmbH & Co., Winnenden (DE)

( * ) Notice: Subject to any disclaimer, the term of this patent is extended or adjusted under 35 U.S.C. 154(b) by 0 days.

(21) Appl. No.: 09/470,612

(22) Filed: Dec. 22, 1999

Related U.S. Application Data

(63) Continuation of application No. PCT/EP98/04140, filed on Jul. 3, 1998.

(30) Foreign Application Priority Data

Jul. 3, 1997 (DE) ..... 197 28 441

(51) Int. Cl.[7] ..... A47L 11/18
(52) U.S. Cl. ..... 015/52.1; 15/98; 15/50.3
(58) Field of Search ..... 15/52, 52.1, 49.1, 15/98, 410, 411, 50.3; 16/430, 437

(56) References Cited

U.S. PATENT DOCUMENTS 2,536,902 * 1/1951 Bechett .
2,821,258 * 1/1958 Benson et al. .
2,842,788 * 7/1958 Rench et al. .
5,381,577 * 1/1995 Lilja ..... 15/49.1

* cited by examiner

*Primary Examiner*—Gary K. Graham
(74) *Attorney, Agent, or Firm*—Barry R. Lipsitz; Douglas M. McAllister

(57) ABSTRACT

In order to facilitate moving with a cleaner comprised, on one side, of two parallel brush-rollers secured to a frame and actuated so as to rotate in opposite directions and, on the other side, of a push bar attached to the frame, it is suggested by the invention that the push bar be fixed at a distance from the frame in the direction of the rotating axis of the brush-rollers and rotationally fixed to the frame to enable a rotation following a cycle parallel to the axis of rotation.

12 Claims, 5 Drawing Sheets

CLEANING DEVICE

This application is a continuation of international application No. PCT/EP98/04140, filed Jul. 3, 1998 Status of application: Pending

BACKGROUND OF THE INVENTION

The invention relates to a cleaning device with two brush rollers that are mounted parallel to one another on a frame and actuated to rotate in opposite directions and with a push handle acting on the frame.

Such a cleaning device is known for example from EP 0 286 328 A1. In such cleaning devices the push handles extend in a direction which runs at right angles to the axes of rotation of the brush roller, so that upon pushing or pulling the cleaning device via the push handle the cleaning device is displaced at right angles to the longitudinal direction of the brush rollers. In this manner the cleaning device can cover a surface to be cleaned.

With this type of cleaning, in which the brush rollers rotate in opposite directions, the propulsive forces of the two brush rollers on the cleaning device counterbalance one another, therefore pushing or pulling forces have to be exerted to displace the cleaning device, since the brush rollers do not contribute to this movement.

SUMMARY OF THE INVENTION

The object of the invention is to develop a generic cleaning device so that the rotational movement of the brush rollers can be used to displace the cleaning device.

According to the present invention there is provided a cleaning device with two brush rollers that are mounted parallel to one another on a frame and are actuated to rotate in opposite directions and with a push handle acting on a frame, which protrudes from the frame in the direction of the axes of rotation of the brush rollers and is connected to the frame in rotationally fixed manner with respect to a rotation about a direction extending parallel to the axes of rotation of the brush rollers, wherein, at its end remote from the frame, the push handle comprises handle elements that are disposed spaced apart at right angles to its longitudinal direction, and the handle elements are disposed substantially symmetrically to a vertical plane that extends parallel to the axes of rotation of the brush rollers and lies between them.

The push handle thus extends at right angles to the direction in which a push handle normally extends in such two-brush devices. This new arrangement of the push handle enables a turning moment to be transmitted via the push handle to the frame bearing the two brush rollers, in which case the frame is swivelled around an axis which extends parallel to the axis of rotation of the brush rollers. This swivelling or tilting of the frame results in that, depending on the swivelling direction, either the one brush roller or the other brush roller is pushed more forcefully against the surface to be cleaned than the respective other brush roller, which on the contrary is slightly raised. These varying pressing forces of the two brush rollers result in a varying reciprocal action of the brush rollers with the surface to be cleaned and thus also in a varying frictional force between the brush roller on the one hand and the surface to be cleaned on the other hand. Whereas in the case of an non-tilted frame the two brush rollers come into contact in the same manner with the surface to be cleaned and therefore the forces exerted on the surface to be cleaned counterbalance one another, this is no longer the case with a tilted frame. In the case of a tilted frame, the frictional force of the more powerfully pressed brush roller predominates and this results in a displacement of the frame according to the direction of rotation of the brush rollers that are pressed more powerfully. The user can then simply control the direction of displacement in that by tilting the frame in the one or in the other direction either the one or the other brush roller presses more strongly against the surface to be cleaned. For example, this may occur alternately so that then such a cleaning device is periodically pushed to and fro without the user for this having to apply a force in the direction of displacement, it being sufficient to perform the tilting of the frame via the push handle, the displacement movement itself being performed by the actuation of the brush rollers.

To facilitate this tilting of the cleaning device, it is preferably specified that at its end remote from the frame the push handle comprises handle elements that are disposed spaced apart at right angles to its longitudinal direction. By these spaced handle elements turning moments can be transmitted via the push handle to the frame, which result in its tilting.

In this case it is advantageous if the handle elements are disposed substantially symmetrically to a vertical plane that extends parallel to the axes of rotation and lies between them, so that the tilting can be achieved in both directions with forces of equal size.

In a preferred embodiment it may be specified that the push handle is swivellably connected to the frame around an axis that extends at right angles to the direction of the axes of rotation. As a result the push handle can be swivelled in its height, possibly also be fixed in different angular positions. A rotationally fixed connection is only necessary in one direction, which extends parallel to the axes of rotation of the brush rollers.

According to a preferred embodiment it is specified that the push handle acts between the brush rollers on the frame, in particular in this case the point of application of the push handle lies on the edge of the frame in the region of the end of the brush rollers.

In a particularly simple embodiment the push handle may take the form of a bar.

However it is also possible to develop the push handle in a manner known per se in the form of a U-shaped curved piece.

In another preferred embodiment it is specified that the push handle can be swivelled around a swivel axis that is perpendicular on the frame into a position in which it protrudes from the frame perpendicularly to the direction of the axes of rotation of the brush rollers. This is the basically normal position of the push handle for a two-brush cleaning device, in this position the cleaning device can be moved in the conventional manner by pushing and pulling forces. This swivelling facility of the push handle thus enables the user optionally to displace the device in the conventional manner or by tilting the frame by the movement of the brush rollers.

In this case it is favourable if the push handle can be fixed in both its positions in which it extends in the direction of the axes of rotation of the brush rollers or at right angles thereto.

Precisely in such an embodiment in which the push handle can also be swivelled into a conventional position that is directed at right angles to the axis of rotation of the brush rollers, it is advantageous if the point of application of the push handle lies at the edge of the frame in the region of the ends of the brush rollers. As a result it is possible for the user to insert the frame with its end lying opposite the point of application under objects, for example under cupboards etc., without the push handle acting on the frame being a nuisance.

In a preferred embodiment it is specified that the push handle be divided into at least two portions, which are fixed adjacent to one another in an operating position, but can be folded together in an inoperative position.

In this case it is particularly favourable if the folded-together portions of the push handle can be laid on the upper side of the frame.

Such a construction enables the push handle to be folded together in a space-saving manner and if necessary it to be laid on the upper side of the device so that overall a very compact structure is achieved when the device is not in use.

BRIEF DESCRIPTION OF THE DRAWINGS

The following description of preferred embodiments of the invention serves in conjunction with the drawings as further explanation.

DETAILED DESCRIPTION OF THE INVENTION

Figure 1:
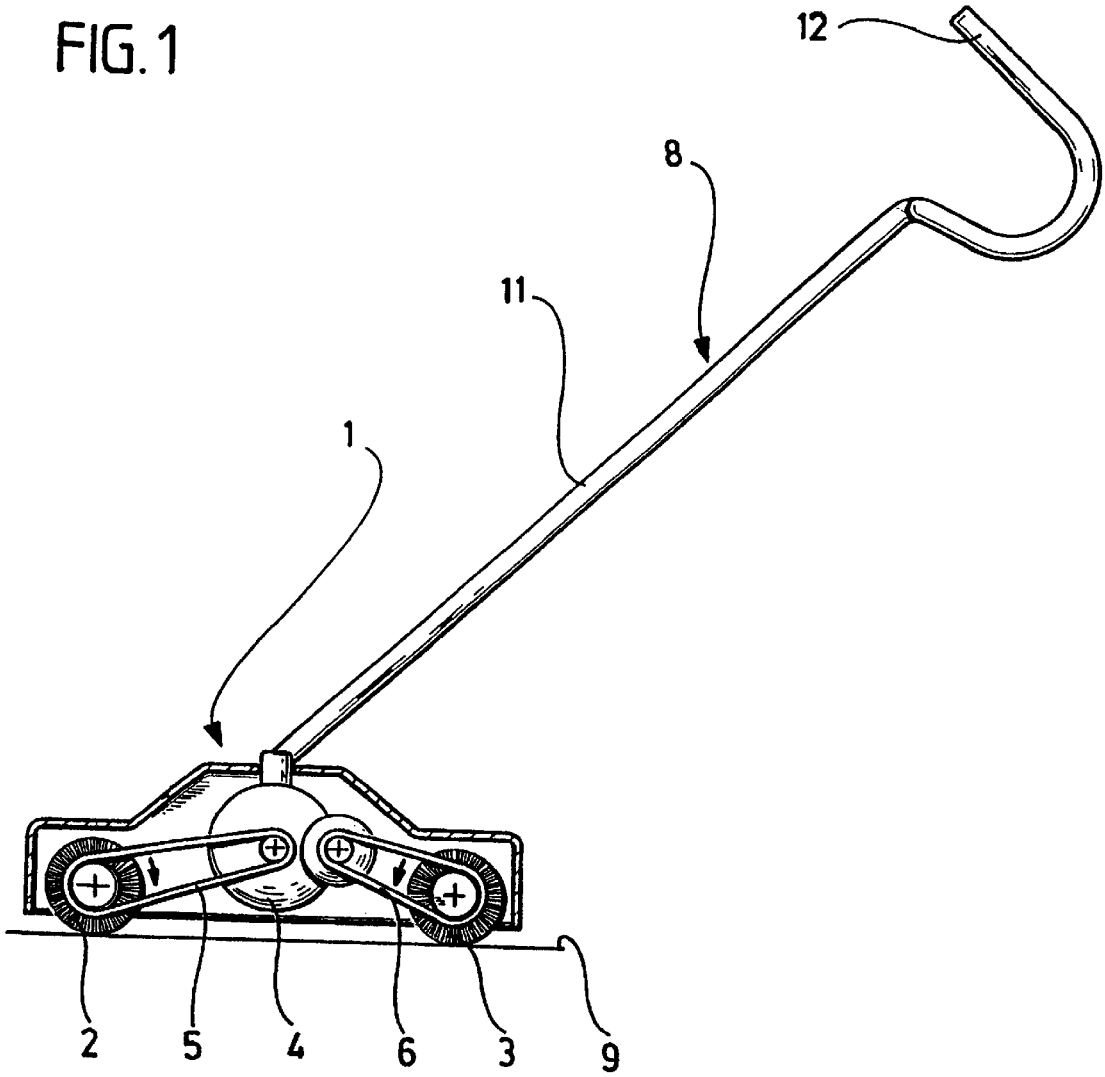
FIG. 1 shows a sectional view along line 1—1 in FIG. 2 in a cleaning device with a push handle in a conventional position.

The cleaning device represented in the drawings comprises a dome-shaped housing 1 open at the bottom, in which two identically formed brush rollers 2, 3 spaced from one another are rotatably mounted around axes of rotation that extend parallel to one another. The brush rollers are actuated so as to rotate in opposite directions via a drive 4 and suitable transmission means, in the exemplified embodiment represented via driving belts 5, 6.

The manner of mounting the brush rollers 2, 3 is not represented in closer detail in the drawings, as here a conventional method is involved. For this bearings can be disposed on a special frame or on the housing, and in the context of this application all these parts which mount the brush rollers 2, 3 are generally designated as "frame".

On the upper side of the housing, in the centre between the two brush rollers 2 and 3 and in the direct vicinity of a side edge 7 of the housing 1 there acts a push handle 8, which, in a manner not evident in further detail from the drawings, is connected to the housing 1 in fixed manner for rotation around an axis which extends parallel to the axes of rotation of the brush rollers 2, 3. However the push handle 8 can be swivelled both around a horizontal swivel axis and also around a vertical swivel axis, which both stand perpendicularly on the axes of rotation of the brush rollers 2, 3.

The swivelling around the horizontal swivel axis results in that the push handle 8 can be swivelled with respect to the plane fixed by the two brush rollers 2, 3 into a different angle of inclination, by suitable means, not represented in the drawings, the push handle may if required be fixed in different angular positions.

Figure 2:
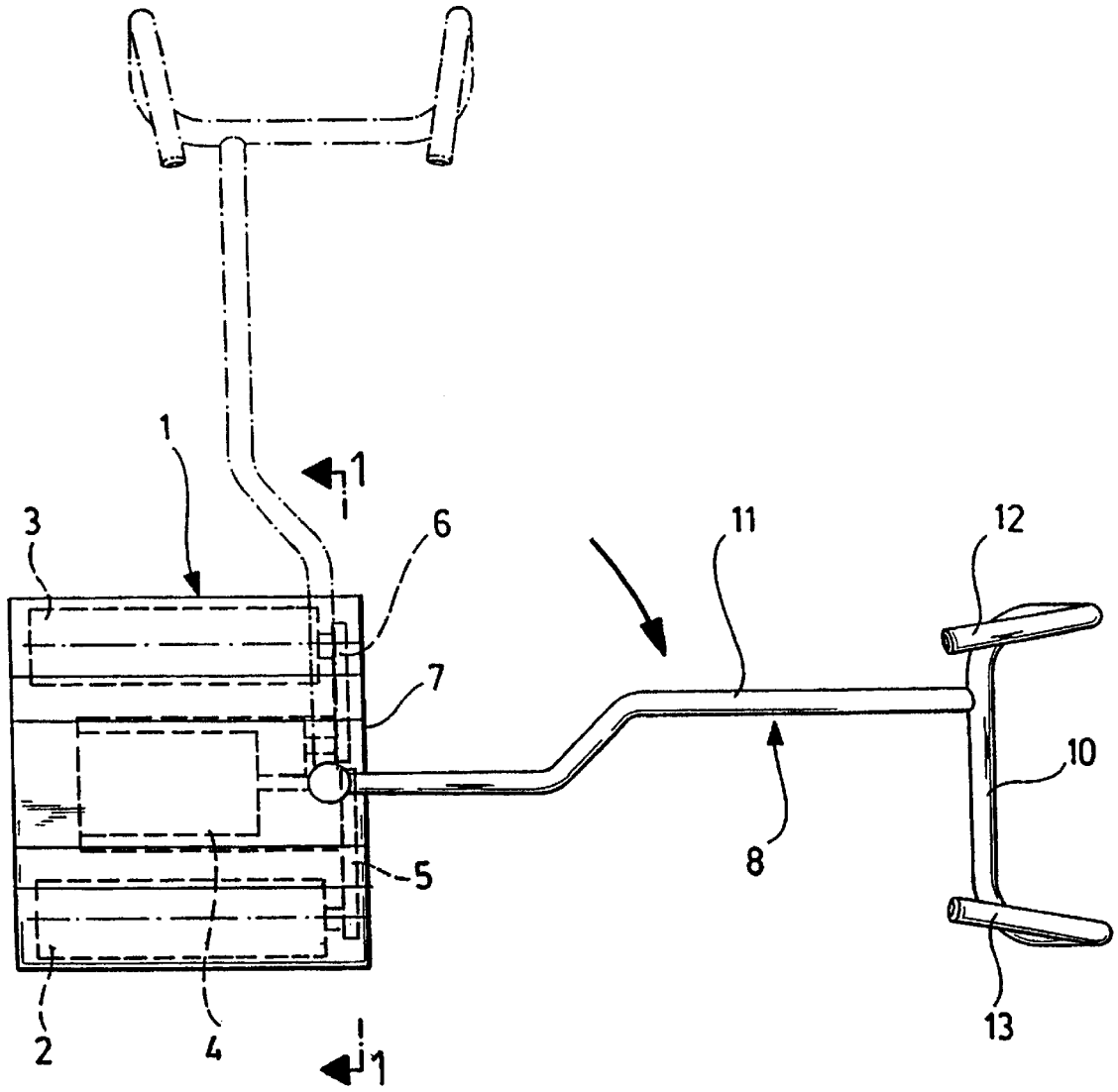
FIG. 2 shows a top view of the cleaning device of FIG. 1 with two different positions of the push handle.

A swivelling of the push handle 8 around the vertical swivel axis results in that the push handle 8 can be swivelled out of a position in which it extends in the direction of the axes of rotation of the brush rollers 2, 3 (in FIG. 2 with solid lines) into a position in which it extends at right angles to the axis of rotation of the brush rollers 2, 3 (in FIG. 2 represented by dot-dash lines). Here too suitable means can be provided to fix the push handle in both described positions.

In the position in which the push handle extends at right angles to the axis of rotation of the brush rollers 2, 3 (in dot-dash lines in FIG. 2), the housing 1 can be displaced by applying pushing and pulling forces, while both brush rollers 2 and 3 press with forces of equal magnitude on a surface 9 to be cleaned.

If the push handle 8 is swivelled into a position in which it extends in the direction of the axes of rotation of the brush rollers 2, 2 (solid lines in FIG. 2), via the push handle 8 a turning moment can be exerted on the housing 1, so that the housing 1 can be tilted. The axis of this tilting runs parallel to the axes of rotation of the brush rollers 2 and 3 and lies between them.

To be able to carry out such a tilting of the housing 1, at its free end the push handle 8 has a crossbar 10, which is connected to the housing 1 via a bar-shaped portion 11 in the described manner and which at its two ends bears handle elements 12, 13 that are spaced from one another. By forcing one of the two handle elements 12 or 13 downwards the housing 1 is tilted in such a manner that one brush roller is pressed securely against the surface to be cleaned 9, while the other is raised from it.

Figure 3:
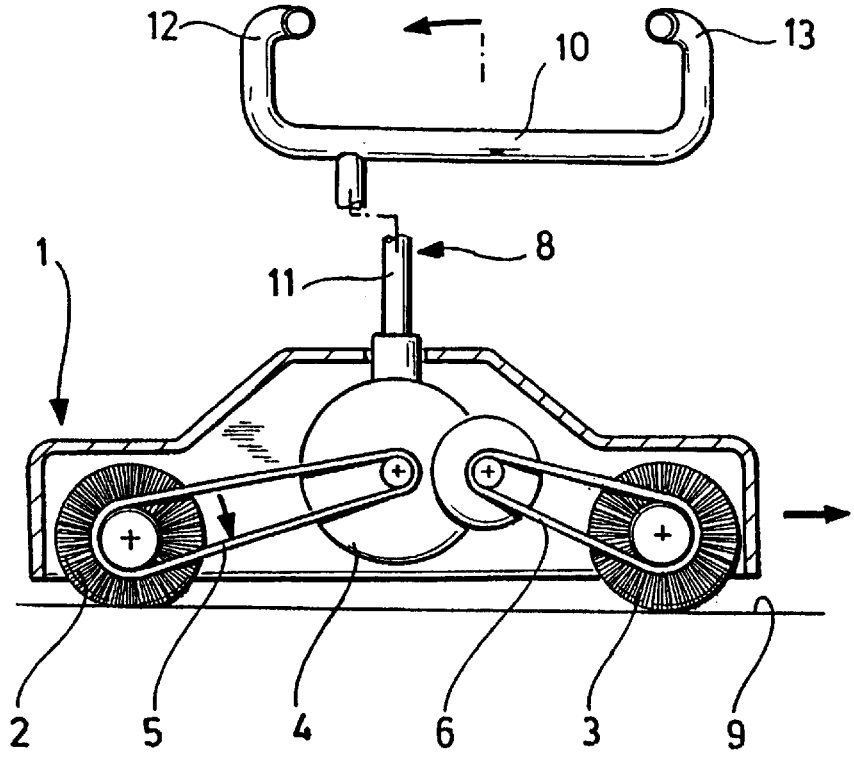
FIG. 3 shows a view similar to FIG. 1 with the push handle perpendicular to the conventional position when tilting the frame in one direction.
Figure 4:
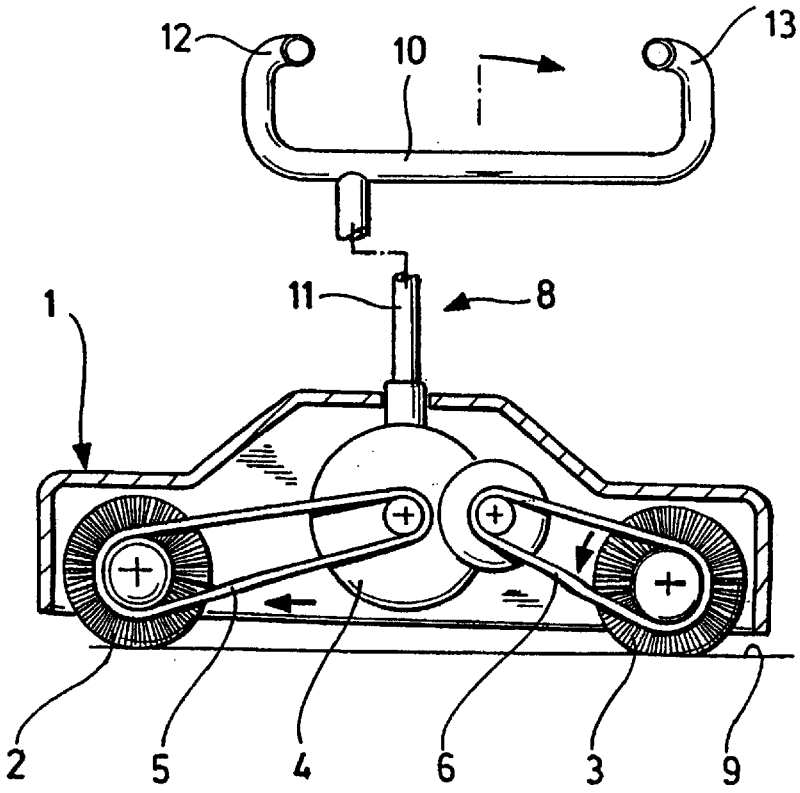
FIG. 4 shows a view similar to FIG. 3 upon the tilting of the frame in the other direction.

This is represented in FIGS. 3 and 4 for different tilting directions. Since the brush rollers are actuated to rotate reciprocally, this results in that in each case the brush roller which is more forcefully pressed transmits its rotational movement more strongly to the surface 9 than the brush roller raised from the surface 9, and this results in a displacement of the housing 1 in relation to the surface 9. The displacement is produced just on the basis of the titling, the user therefore only has to apply the forces for the titling to achieve a displacement of the housing 1, the actual displacement movement is produced by the drive 4.

By pressing alternately on the handle elements 12 and 13 the housing 1 can consequently be alternately tilted in the one or the other direction, and this results in an alternate displacement of the housing 1 in the one direction or in the other direction.

By swivelling the push handle around the vertical swivel axis, the user can choose at any time whether he wants to move the housing 1 in the conventional manner by pushing and pulling or whether he wants to trigger the displacement movement of the housing just by tilting the housing and then wishes to carry it out by the drive of the device.

Figure 5:
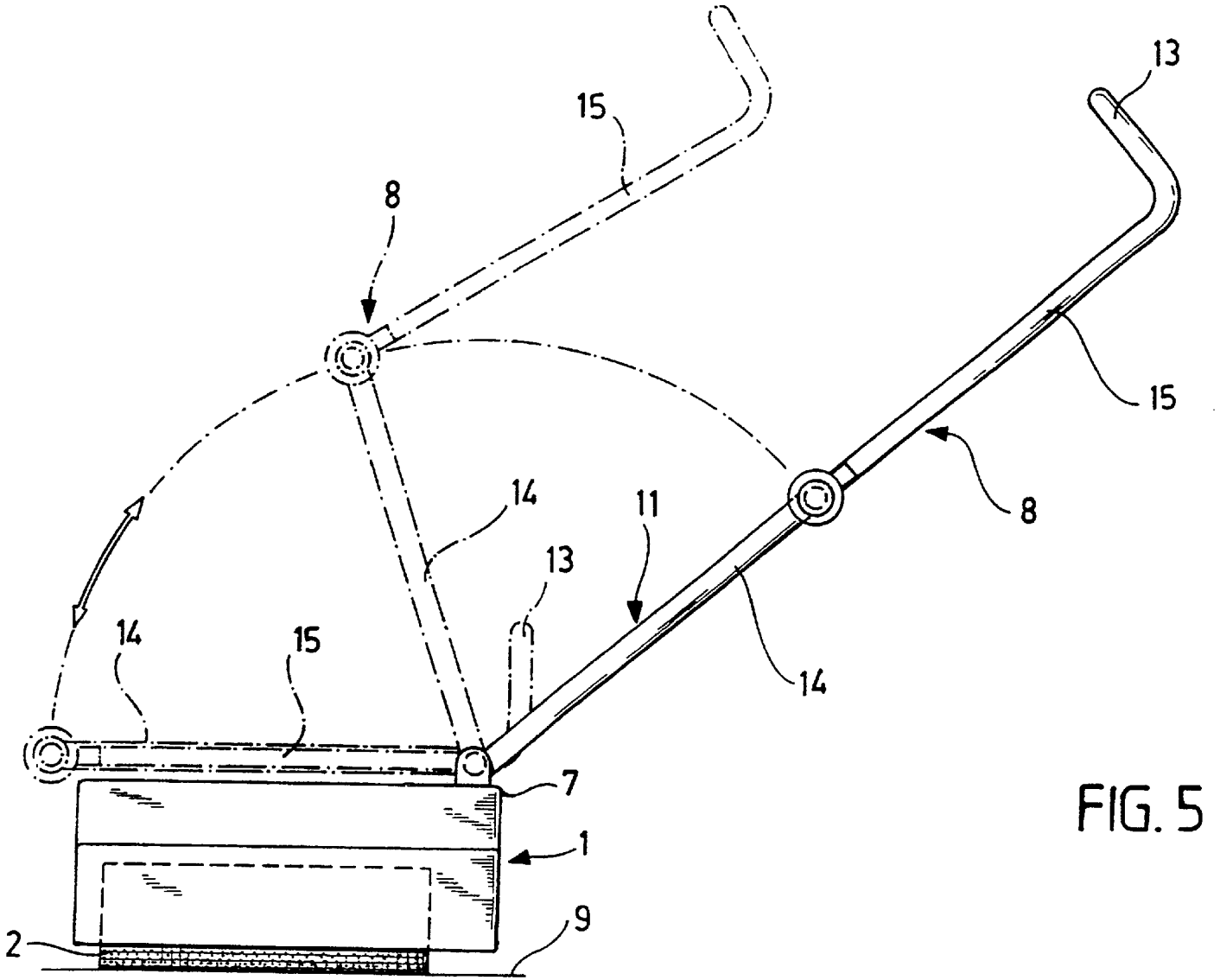
FIG. 5 shows a diagrammatic front view of a cleaning device with a push handle that can be folded down in the centre and FIG. 6 shows a view similar to FIG. 2 with the cleaning device of FIG. 5 with a folded-out push handle and with a folded-in push handle.
Figure 6:
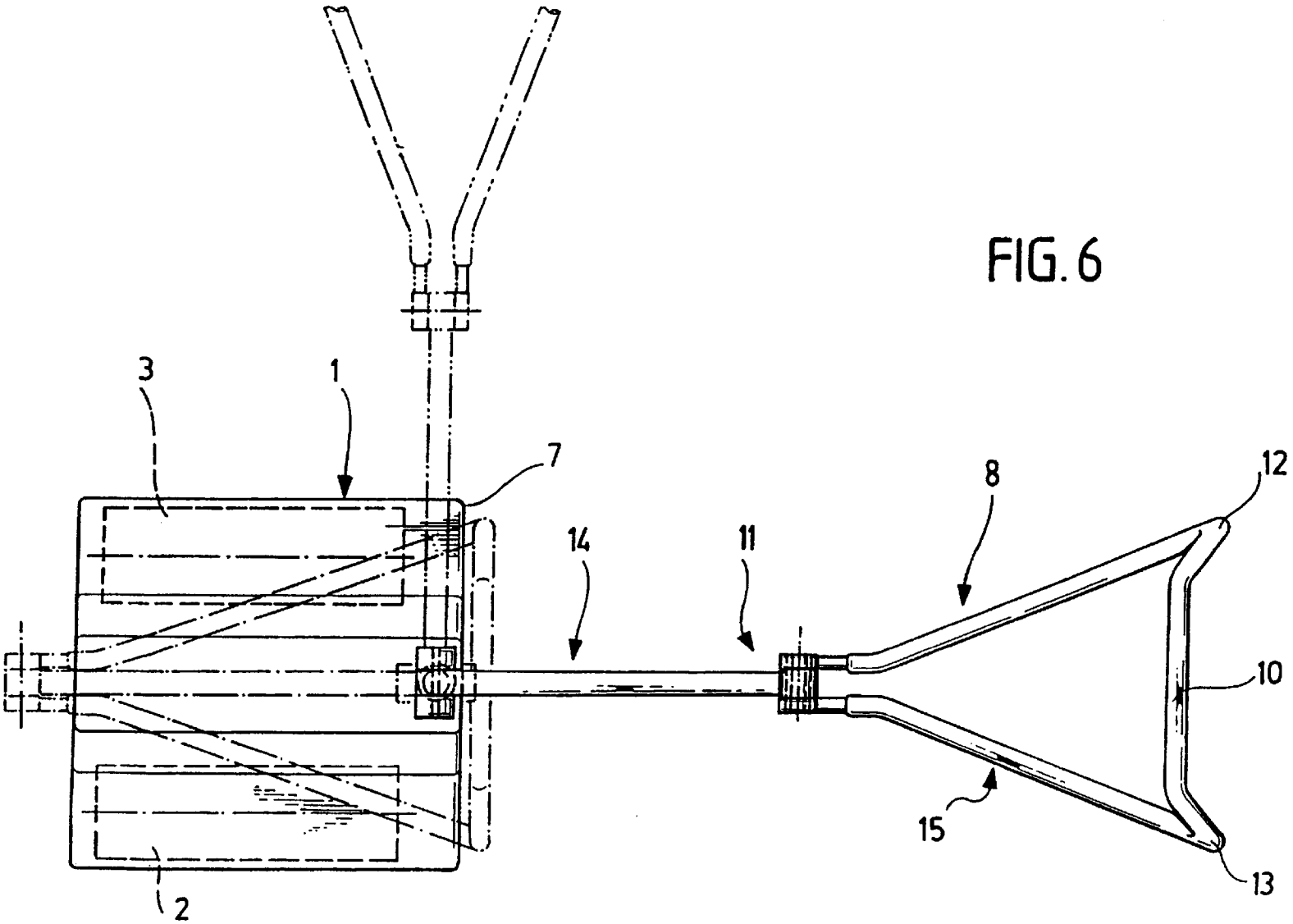

Represented in FIGS. 5 and 6 is a modified exemplified embodiment of a cleaning device, which is essentially constructed in the same manner as that of FIGS. 1 to 4. Identical parts therefore have the same reference numbers.

In contrast to the exemplified embodiment of FIGS. 1 to 4, in the case of the cleaning device of FIGS. 5 and 6 the push handle 8 is divided in its centre into a lower portion 14 and an upper portion 15, which are swivellably connected to one another around an axis extending at right angles to the longitudinal axis of the push handle 8. The two portions 14 and 15 can be locked in relation to one another by a suitable device, which is not specified in further detail in the drawings, so that a swivelling of the portions 14 and 15 in relation to one another is not possible.

In its mounting on the housing 1, the push handle 8 can swivel around another axis which runs parallel to the swivel axis of the portions 14 and 15 and can also be fixed if required.

By this embodiment it is possible to accommodate the push handle 8 in a space-saving manner on the upper side of the housing 1, when the device is not in operation. For this the lower portion 14 is swivelled parallel to the upper side of the housing 1, the upper portion is folded by 180° in relation to the lower portion 14 and also laid down on the upper side of the housing, as can be seen from FIG. 5. As a result a very compact folding together of the push handle on the upper side of the housing is produced.

What is claimed is:

1. A cleaning device comprising:

a frame;

a drive motor mounted to said frame;

two brush rollers that are mounted parallel to one another on the frame and are actuated by said drive motor to rotate in opposite directions; and a push handle attached to the frame;

said push handle being rigidly connected to the frame with respect to a longitudinal axis of said handle, said connection located on said frame at a point substantially midway between said brush rollers, and said longitudinal axis of said handle defining a first vertical plane that, in a first orientation, extends parallel to and lies between respective second and third vertical planes defined by said axes of rotation of said brush rollers;

wherein, at an end of the push handle remote from the frame, the push handle comprises handle elements that are symmetrically disposed spaced apart at substantially right angles to said longitudinal axis of said push handle.

2. The cleaning device of claim 1, further comprising a swivel connection connecting the push handle to the frame around a horizontal swivel axis that extends at right angles to the direction of the axes of rotation of the brush rollers.

3. The cleaning device of claim 2, wherein the push handle acts between the brush rollers on the frame.

4. The cleaning device of claim 2, wherein the push handle can be swiveled around a vertical swivel axis into a second orientation in which the handle protrudes from the frame such that the first vertical plane is perpendicular to the second and third vertical planes.

5. The cleaning device of claim 4, wherein the push handle can be fixed in one of said first orientation or said second orientation.

6. The cleaning device of claim 1, wherein the push handle acts between the brush rollers on the frame.

7. The cleaning device of claim 1, wherein the push handle is bar shaped.

8. The cleaning device of claim 1, wherein the handle elements form a U-shaped curved piece.

9. The cleaning device of claim 1, wherein the push handle can be swiveled around a vertical swivel axis into a second orientation in which the handle protrudes from the frame such that the first vertical plane is perpendicular to the second and third vertical planes.

10. The cleaning device of claim 9, wherein the push handle can be fixed in one of said first orientation or said second orientation.

11. The cleaning device of claim 1, wherein the push handle is divided into at least two portions, which can be fixed adjacent to one another in an operating position or folded together in an inoperative position.

12. The cleaning device of claim 11, wherein the folded-together portions of the push handle can be laid on an upper side of the frame.

* * * * *